United States Patent [19]

Diamantis

[11] Patent Number: 4,843,675

[45] Date of Patent: Jul. 4, 1989

[54] TWO PIECE REMOVABLE-CURTAIN GROMMET

[76] Inventor: Panayiotis Diamantis, 805 Ward Ave., Huntsville, Ala. 35801

[21] Appl. No.: 248,107

[22] Filed: Sep. 23, 1988

[51] Int. Cl.[4] ..... F16L 5/00

[52] U.S. Cl. ..... 16/2; 24/141

[58] Field of Search ..... 16/2, 108, 109; 248/56; 174/65 G, 152 G, 153 G; 24/141, 142, 573

[56] References Cited

U.S. PATENT DOCUMENTS

| | | | |
|---|---|---|---|
| 1,334,163 | 3/1920 | Neuberth | 24/141 |
| 4,372,013 | 2/1983 | Gautier, Jr. | 24/141 |
| 4,656,689 | 4/1987 | Dennis | 10/2 |

*Primary Examiner*—Fred A. Silverberg

*Attorney, Agent, or Firm*—Joseph H. Beumer

[57] ABSTRACT

An annular grommet for supporting lightweight curtains for sliding on a rod has mating halves with flat surfaces. One half has one or more alignment tines extending from the flat surface between its edges at one end and engagement tines at its inner edge at the other end and near the middle. The other half has slots and a hole located so as to receive the tines when the halves are pressed together. The alignment tine enables the halves to be aligned with an aperture in a curtain and with one another for engaging the halves. The grommet may be readily installed and removed by hand, thus facilitating disassembly for laundering.

8 Claims, 2 Drawing Sheets

TWO PIECE REMOVABLE-CURTAIN GROMMET

FIELD OF THE INVENTION

This invention relates generally to grommets and more particularly to hand-engageable grommets for supporting curtains.

BACKGROUND OF THE INVENTION

One of the requirements for hanging curtains, drapery, or the like is the provision of suitable hardware for supporting the curtain at its top and enabling it to be slid along a rod. Drapery hooks made of metal wire and designed for pinning into the cloth are widely used for heavy fabrics, but they are not suitable for use on lightweight or sheer fabrics.

One type of curtain for which a different kind of support is needed is a vertically pleated lightweight curtain manufactured with built-in vertical "hinges" spaced some four inches apart, the curtain folding or unfolding as it moves along a horizontal rod. This type of curtain uses a somewhat open mesh fabric of material such as polyester prepared by knitting, with openings through the fabric being provided in the knitting process. Supporting hardware such as grommets for this type of curtain would damage the curtain if not removed during laundering; thus, they should be readily engageable and removable by hand to allow repeated laundering.

Various annular grommets having two halves that are secured together by engageable tines are shown by prior patents, exemplified by U.S. Pat. Nos. 1,334,163; 4,372,013; and 4,656,689. The grommets disclosed in these patents are intended for heavy duty usage and would not be removable by hand. In addition, all of the tines of these grommets serve to secure the halves together, and no separate tine is provided for alignment purposes. Without such additional tine, proper alignment of the grommet halves at the desired location on the fabric while snapping the halves together is difficult to attain.

SUMMARY OF THE INVENTION

In the present invention, an annular grommet is provided with two halves, each having a flat surface that mates with the other. One of the halves has a plurality of tines extending perpendicular from its flat surface adjacent to its inner edge, and the other half has notches at its inner edge adapted to receive the tines when the halves are brought together. At least one alignment tine is provided on one of the halves perpendicular to its flat surface and intermediate its edges, with the other half having one or more openings in its flat surface to receive the alignment tine or tines. The tines at the inner edge are biased to snap into position when engaging the opposing notches, resulting in a secured but removable connection with sufficient strength to firmly support a lightweight curtain for sliding on a rod. The alignment tine or tines enable the two halves to be readily brought into proper position around an aperture in the curtain prior to snapping the two halves together. Removal of the grommet for laundering the curtain may be easily carried out manually by prying the two halves apart with one's fingernail or a suitable blade.

It is, therefore, an object of this invention to provide a curtain grommet that may be readily installed and removed by hand.

Another object is to provide a grommet having a means for bringing its mating halves into alignment on a fabric.

Yet another object is to provide a hand-engageable grommet for supporting a lightweight curtain for sliding on a rod.

Other objects and advantages of the invention will be apparent from the following description and appended claims.

DESCRIPTION OF THE PREFERRED EMBODIMENT

Figure 1:
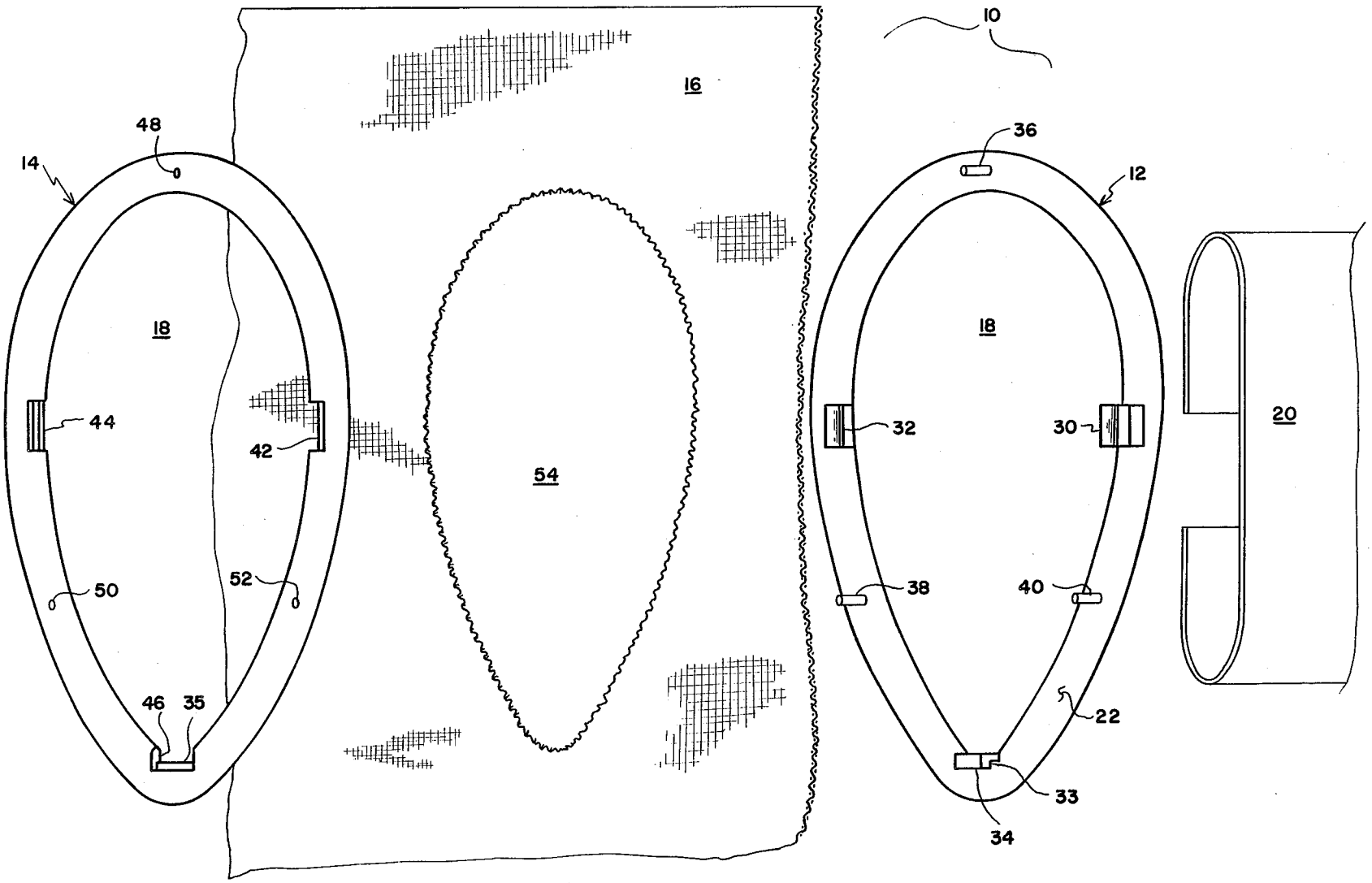
FIG. 1 is an exploded pictorial view showing a grommet embodying the invention with its halves aligned for engagement.

Referring to FIG. 1, there is shown a two-part ring grommet 10 with its two halves 12 and 14 disengaged but aligned for engagement to support curtain 16. The grommet has an annular configuration defining a central aperture 18 shaped to slide over a curtain rod 20. In the embodiment shown, the grommet has a generally oval shape conforming to the oblong cross-sectional shape of the curtain rod. The grommet shape may be varied as desired for a particular application; for example, a circular shape may be used for a curtain rod of circular cross section.

Figure 3:
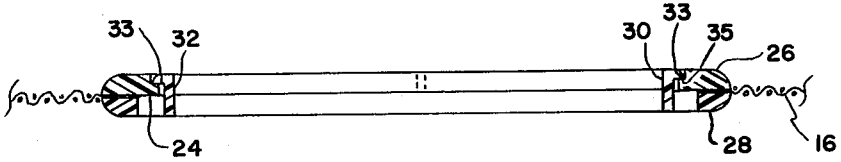
FIG. 3 is a sectional view taken along line 3—3 of FIG. 2.
Figure 2:
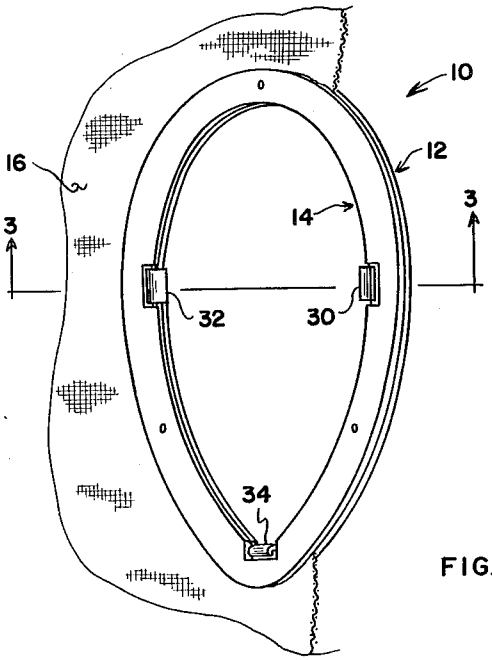
FIG. 2 is a pictorial view showing the grommet of FIG. 1 in engaged position.

The grommet halves 12 and 14 have flat surfaces 22 and 24 (FIG. 3) that are brought together upon engagement, the outer faces 26 and 28 of the halves being rounded to provide a generally oval cross section for the grommet when engaged, with sharp corners being avoided to prevent snagging. Grommet half 12 has three tines 30, 32, and 34 of rectangular cross section extending perpendicularly outward from surface 22 at the grommet inner edge defining aperture 18. These tines at their distal end each have a shoulder 33 generally parallel to flat surface 22. Tines 36, 38, and 40 of circular cross section are also provided extending outward perpendicularly from surface 22 at a location away from the edge of grommet half 12. Tines 30, 32, and 34 mate with corresponding slots 42, 44, and 46 in grommet half 14, the slots including notches 35 for receiving shoulders 33 of the tines. Apertures 48, 50, and 52 are located away from the grommet edge and have a circular shape for receiving circular shaped tines 36, 38, and 40. Tines 30, 32, and 34 are located and sized such that their inner edges frictionally engage inner edges of slots 42, 44, and 46 and enable the tines to snap firmly in position upon pressing the grommet halves together.

Tines 36, 38, and 40, being spaced apart from the inner edge of the grommet, may readily penetrate the curtain at a location away from the edge of the curtain and provide for securing grommet half 12 in position around aperture 54 in the curtain. Upon grommet half 12 being placed in such position, half 14 may be readily engaged therewith by bringing the halves together so that tine 36 is positioned slightly within aperture 48 and moving half 14 around an axis defined by tine 36 until the remaining tines come into alignment with their respective mating slots or apertures. The aligned halves may then be pressed together so as to cause the engagement tines to snap into position.

As shown in the drawings, the curtain is provided with apertures 54 corresponding in shape to the grommet shape. In the case of vertically pleated, hinged curtains, one aperture and grommet would preferably be provided for each vertically extending section.

I claim:

1. A curtain grommet comprising:

two annular halves, each having a generally semi-circular cross section and a flat surface adapted to be placed against a flat surface of the other half;

one of said halves including a plurality of engagement tines extending perpendicularly from its flat surface at an inner edge thereof and at least one alignment tine extending perpendicularly from said surface at a position spaced apart from said inner edge; and the other of said halves including notches at an inner edge thereof for receiving said engagement tines in frictional fit relationship and a hole spaced apart from said inner edge for receiving said alignment tine;

whereby said halves may be aligned over an aperture in a curtain and may be removably engaged by being pressed together.

2. A curtain grommet as defined in claim 1 wherein said alignment tine is located near one end of said grommet, and said engagement tines are located at the opposite end and at positions about half-way between the ends.

3. A curtain grommet as defined in claim 1 wherein the grommet is generally oval in shape.

4. A curtain grommet as defined in claim 1 wherein said engagement tines have a rectangular cross section.

5. A curtain grommet as defined in claim 4 wherein said alignment grommet has a generally circular cross section.

6. A curtain grommet as defined in claim 4 wherein said engagement tines each include at their distal ends a shoulder adapted to snap into position in the notch with which the tine is engageable.

7. A curtain grommet as defined in claim 6 including three alignment tines.

8. A curtain grommet as defined in claim 1 wherein said grommet is made of plastic.

* * * * *